US009664031B2

(12) United States Patent
Mills

(10) Patent No.: US 9,664,031 B2
(45) Date of Patent: May 30, 2017

(54) METHODS AND APPARATUS FOR CALIBRATING CONTROLLERS FOR USE WITH WELLS

(71) Applicant: Bristol, Inc., Watertown, CT (US)

(72) Inventor: Thomas Matthew Mills, Katy, TX (US)

(73) Assignee: Bristol, Inc., Watertown, CT (US)

( * ) Notice: Subject to any disclaimer, the term of this patent is extended or adjusted under 35 U.S.C. 154(b) by 596 days.

(21) Appl. No.: 14/213,402

(22) Filed: Mar. 14, 2014

(65) Prior Publication Data

US 2015/0260033 A1 Sep. 17, 2015

(51) Int. Cl.
*E21B 47/00* (2012.01)
*E21B 43/12* (2006.01)

(52) U.S. Cl.
CPC ..... *E21B 47/0007* (2013.01); *E21B 43/127* (2013.01); *E21B 47/0008* (2013.01)

(58) Field of Classification Search
CPC ..... E21B 47/0007
USPC ..... 702/94
See application file for complete search history.

(56) References Cited

U.S. PATENT DOCUMENTS 4,483,188 A * 11/1984 McTamaney ..... H03M 7/50 346/33 WL
4,490,094 A 12/1984 Gibbs
4,541,274 A 9/1985 Purcupile
5,291,777 A 3/1994 Chang et al.
5,362,206 A 11/1994 Westerman et al.
5,464,058 A 11/1995 McCoy et al.
2013/0127390 A1 5/2013 DaCunha et al.

OTHER PUBLICATIONS

Patent Cooperation Treaty, "International Search Report," issued in connection with PCT Application No. PCT/US2015/020322, mailed on Jul. 31, 2015, 6 pages.
Patent Cooperation Treaty, "Written Opinion," issued in connection with PCT Application No. PCT/US2015/020322, mailed on Jul. 31, 2015, 8 pages.
Guo et al., "The Indicator Diagram Collection Based on Beam Pumping Unit Motor Effective Power Measurement," Mar. 28, 2013, International Petroleum Technology Conference, retrieved on Jul. 21, 2015, 24 pages.
International Searching Authority, "International Preliminary Report on Patentability," issued in connection with PCT Patent Application No. PCT/US2015/020322, issued on Sep. 14, 2016, 8 pages.

* cited by examiner

*Primary Examiner* — Bryan Bui
(74) *Attorney, Agent, or Firm* — Hanley, Flight & Zimmerman, LLC

(57) ABSTRACT

Methods and apparatus for calibrating controllers for use with wells are disclosed. An example method includes moving a polished rod of a pumping unit through a first cycle of the pumping unit using a motor and determining first pulse count values of the motor through the first cycle using a first sensor at first times. The first times are substantially equally spaced. The method also includes determining first position values of the polished rod through the first cycle using a second sensor at the first times and associating the first pulse count values with respective ones of the first position values to calibrate a processor of the pumping unit.

18 Claims, 7 Drawing Sheets

300

| 302 TIME [SECONDS] | 304 MOTOR PULSE COUNT | 306 POSITION [INCH] | 302 TIME [SECONDS] | 304 MOTOR PULSE COUNT | 306 POSITION [INCH] | 302 TIME [SECONDS] | 304 MOTOR PULSE COUNT | 306 POSITION [INCH] | 302 TIME [SECONDS] | 304 MOTOR PULSE COUNT | 306 POSITION [INCH] |
|---|---|---|---|---|---|---|---|---|---|---|---|
| 0 | 0 | 12.59441 | 2.05 | 237 | 74.57537 | 4.05 | 458 | 72.78343 | 6.05 | 698 | 11.42419 |
| 0.05 | 6 | 13.81157 | 2.1 | 243 | 75.60715 | 4.1 | 464 | 70.92627 | 6.1 | 704 | 10.30254 |
| 0.1 | 12 | 15.07373 | 2.15 | 249 | 76.76353 | 4.15 | 470 | 69.62104 | 6.15 | 710 | 9.231372 |
| 0.15 | 18 | .16.37696 | 2.2 | 255 | 77.75773 | 4.2 | 476 | 68.27477 | 6.2 | 716 | 8.712269 |
| 0.2 | 24 | 17.72525 | 2.25 | 261 | 78.75314 | 4.25 | 482 | 66.38952 | 6.25 | 722 | 7.245807 |
| 0.25 | 30 | 19.11042 | 2.3 | 267 | 79.66313 | 4.3 | 488 | 65.45744 | 6.3 | 728 | 6.356472 |
| 0.3 | 36 | 20.53256 | 2.35 | 273 | 80.51733 | 4.35 | 494 | 64.03071 | 6.35 | 734 | 5.482672 |
| 0.35 | 42 | 21.93979 | 2.4 | 279 | 81.52323 | 4.4 | 500 | 62.52159 | 6.4 | 740 | 4.685719 |
| 0.4 | 48 | 23.47841 | 2.45 | 285 | 82.05016 | 4.45 | 506 | 61.00237 | 6.45 | 746 | 3.949544 |
| 0.45 | 54 | 24.99761 | 2.5 | 291 | 82.72612 | 4.5 | 512 | 59.45539 | 6.5 | 752 | 3.27318 |
| 0.5 | 60 | 26.54461 | 2.55 | 297 | 83.34213 | 4.55 | 518 | 57.88300 | 6.55 | 758 | 2.657773 |
| 0.55 | 66 | 28.11697 | 2.6 | 303 | 83.89543 | 4.6 | 524 | 56.29773 | 6.6 | 764 | 2.30457 |
| 0.6 | 72 | 29.71227 | 2.65 | 309 | 84.38530 | 4.65 | 530 | 54.67194 | 6.65 | 770 | 1.614425 |
| 0.65 | 78 | 31.32804 | 2.7 | 315 | 84.81191 | 4.7 | 536 | 53.03815 | 6.7 | 776 | 1.188093 |
| 0.7 | 84 | 10.96145 | 2.75 | 321 | 85.17377 | 4.75 | 542 | 51.38880 | 6.75 | 782 | 0.826233 |
| 0.75 | 90 | 34.61112 | 2.8 | 327 | 85.4704 | 4.8 | 548 | 49.72665 | 6.8 | 788 | 0.529401 |
| 0.8 | 96 | 36.27332 | 2.85 | 333 | 85.70014 | 4.85 | 554 | 48.06411 | 6.85 | 794 | 0.298056 |
| 0.85 | 102 | 37.94583 | 2.9 | 339 | 85.86745 | 4.9 | 560 | 46.37374 | 6.9 | 800 | 0.132555 |
| 0.9 | 108 | 39.60604 | 2.95 | 344 | 85.56635 | 4.95 | 566 | 44.68317 | 6.95 | 806 | 0.033151 |
| 0.95 | 114 | 41.01140 | 3 | 349 | 86 | 5 | 572 | 43 | 7 | 812 | 0 |
| 1 | 119 | 43 | 3.05 | 354 | 85.90645 | 5.05 | 578 | 41.31185 | 7.05 | 818 | 0.033151 |
| 1.05 | 124 | 44.68817 | 3.1 | 359 | 85.81045 | 5.1 | 584 | 39.62526 | 7.1 | 824 | 0.182555 |
| 1.1 | 129 | 46.37374 | 3.15 | 364 | 85.70154 | 5.15 | 590 | 37.94587 | 7.15 | 830 | 0.298056 |
| 1.15 | 134 | 48.03414 | 3.2 | 369 | 85.0706 | 5.2 | 596 | 36.27332 | 7.2 | 836 | 0.529401 |
| 1.2 | 139 | 49.72668 | 3.25 | 374 | 85.17377 | 5.25 | 602 | 34.61112 | 7.25 | 842 | 0.826233 |
| 1.25 | 144 | 51.88882 | 3.3 | 379 | 84.01191 | 5.3 | 608 | 32.96135 | 7.3 | 848 | 1.188093 |
| 1.3 | 149 | 53.03815 | 3.35 | 384 | 84.18550 | 5.35 | 614 | 31.32806 | 7.35 | 854 | 1.614425 |
| 1.35 | 154 | 54.63194 | 3.4 | 389 | 83.39543 | 5.4 | 620 | 29.71227 | 7.4 | 860 | 2.30457 |
| 1.4 | 159 | 56.29771 | 3.45 | 394 | 83.34214 | 5.45 | 626 | 28.11697 | 7.45 | 866 | 2.657773 |
| 1.45 | 165 | 57.88931 | 3.5 | 399 | 82.72683 | 5.5 | 632 | 26.54461 | 7.5 | 872 | 3.27318 |
| 1.5 | 171 | 59.45500 | 3.55 | 404 | 82.05010 | 5.55 | 638 | 24.90743 | 7.55 | 878 | 3.949544 |
| 1.55 | 177 | 61.00237 | 3.6 | 409 | 81.31936 | 5.6 | 644 | 23.47841 | 7.6 | 884 | 4.685719 |
| 1.6 | 183 | 62.52514 | 3.65 | 414 | 80.51735 | 5.65 | 650 | 21.91929 | 7.65 | 890 | 5.482672 |
| 1.65 | 189 | 64.05075 | 3.7 | 419 | 79.66355 | 5.7 | 656 | 20.53254 | 7.7 | 896 | 6.356472 |
| 1.7 | 195 | 65.46744 | 3.75 | 424 | 78.75515 | 5.75 | 662 | 19.11045 | 7.75 | 902 | 7.245807 |
| 1.75 | 201 | 66.07752 | 3.8 | 429 | 77.78775 | 5.8 | 668 | 17.72523 | 7.8 | 908 | 8.712269 |
| 1.8 | 207 | 68.37477 | 3.85 | 434 | 76.76868 | 5.85 | 674 | 16.37896 | 7.85 | 914 | 9.231372 |
| 1.85 | 213 | 69.62104 | 3.9 | 440 | 75.00745 | 5.9 | 680 | 15.07373 | 7.9 | 920 | 10.30254 |
| 1.9 | 219 | 70.92627 | 3.95 | 446 | 77.57587 | 5.95 | 686 | 13.81157 | 7.95 | 926 | 11.42419 |
| 1.95 | 225 | 72.18843 | 4 | 452 | 73.40565 | 6 | 692 | 12.59441 | 8 | 932 | 12.59441 |

FIG. 3

METHODS AND APPARATUS FOR CALIBRATING CONTROLLERS FOR USE WITH WELLS

FIELD OF THE DISCLOSURE

This disclosure relates generally to controllers and, more particularly, to methods and apparatus for calibrating controllers for use with wells.

BACKGROUND

Pumping units are used to operate downhole pumps that pump oil from an oil well. In some instances, data is collected to generate dynamometer cards that assist in determining the performance of the pumping units and its associated components. To ensure accuracy of the generated dynamometer cards, the collected data must also be accurate.

BRIEF DESCRIPTION OF THE DRAWINGS

FIG. 3 shows an example reference table generated during an example calibration process in accordance with the teachings of this disclosure.

The figures are not to scale. Wherever possible, the same reference numbers will be used throughout the drawing(s) and accompanying written description to refer to the same or like parts.

DETAILED DESCRIPTION

The examples disclosed herein relate to example rod pump controllers and related methods to precisely identify a position of a polished rod of a pumping unit throughout a stroke of a corresponding pump. The data obtained via the examples disclosed herein can be used to determine the velocity of the polished rod, the acceleration of the polished rod and/or to generate a rod pump dynamometer card, a surface dynamometer card, a pump dynamometer card, etc.

To enable the position of a polished rod to be accurately determined during normal and/or continuous operation, in some disclosed examples, an example calibration process is performed prior to initiating the normal and/or continuous operation of the pumping unit. In some examples, the calibration process includes monitoring a position of the polished rod, a position of a crank arm and an angular position of a shaft of a motor used to move the polished rod. Based on this monitoring, a relationship and/or correlation between the positions is established. Once the pumping unit is calibrated, a relatively accurate position of the polished rod throughout its stroke and/or cycle may be determined by monitoring the rotations of the motor and/or shaft and crank arm in combination with the calibration data.

In contrast to some known examples, the examples disclosed herein improve the accuracy of determining the polished rod position while also reducing the amount of time and effort associated with configuration. Specifically, some known rod pump controllers involve a time consuming configuration for which a technician has to accurately determine a pump stroke offset value that may be different for each pumping unit. The pump stroke offset value may be defined between a position reset signal and an indication that the polished rod has reached the top or bottom of a stroke. The position reset signal may indicate that the crank arm has reached a specific location.

The position of the polished rod throughout its stroke in combination with other parameters (e.g., polished rod load, polished rod tension) may be used to generate corresponding dynamometer card(s). As a result, inaccuracies in the pump stroke offset value may result in errors or inaccuracies in the generated dynamometer card(s). In contrast to known examples that require technicians to determine the pump stroke offset value and the dimensions of each pumping unit assembly, the examples disclosed herein automatically determine pump stoke offset values and incorporate these values into the process of accurately determining polished rod position without technician involvement.

Figure 1:
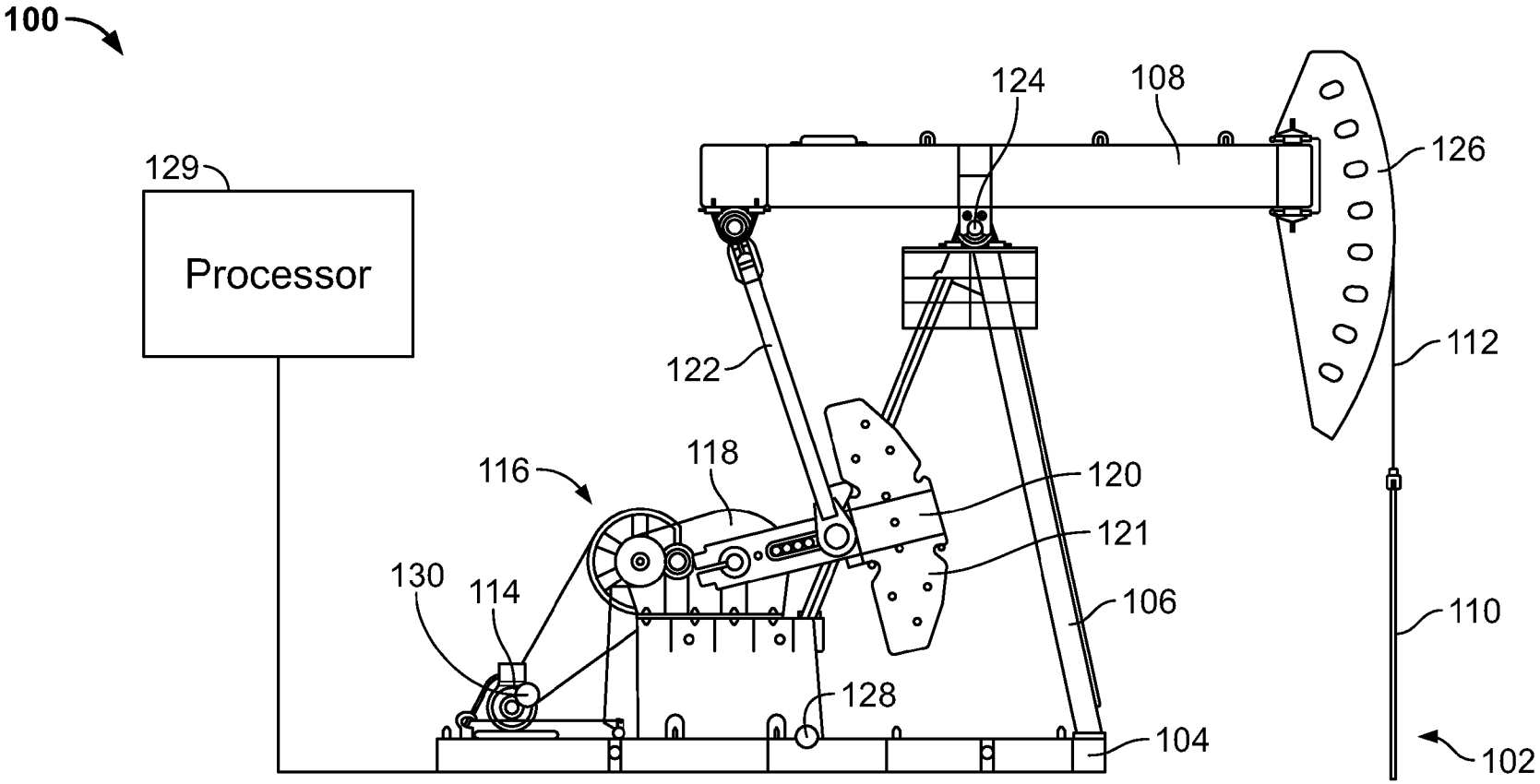
FIG. 1 (PRIOR ART)
FIG. 1 shows a known pumping unit.

FIG. 1 shows a known crank arm balanced pumping unit and/or pumping unit 100 that can be used to produce oil from an oil well 102. The pumping unit 100 includes a base 104, a Sampson post 106 and a walking beam 108. The walking beam 108 may be used to reciprocate a polished rod 110 relative to the oil well 102 via a bridle 112.

The pumping unit 100 includes a motor or engine 114 that drives a belt and sheave system 116 to rotate a gear box 118 and, in turn, rotate a crank arm 120 and a counterweight 121. A pitman 122 is coupled between the crank arm 120 and the walking beam 108 such that rotation of the crank arm 120 moves the pitman 122 and the walking beam 108. As the walking beam 108 pivots about a pivot point and/or saddle bearing 124, the walking beam 108 moves a horse head 126 and the polished rod 110.

To detect when the crank arm 120 completes a cycle and/or passes a particular angular position, a first sensor 128 is coupled adjacent to the crank arm 120. To detect and/or monitor a number of revolutions of the motor 114, a second sensor 130 is coupled adjacent the motor 114. In the example of FIG. 1, the couplings (e.g., the belt and sheeve system 116, the gear box 118, etc.) between the motor 114 and the crank arm 120 are assumed to be rigid. Thus, it is assumed that a predetermined number of revolutions of the motor 114 will be detected for a single revolution of the crank arm 120.

Data obtained from the first sensor 128 and/or the second sensor 130 may be used to determine a position of the crank arm 120 versus time for each stroke of the pumping unit 100. Additionally or alternatively, based on the measurements of the pumping unit 100, a pumping unit specific four-bar-linkage calculation can be performed that relates the position of the crank arm 120 to the position of the polished rod 110 throughout the stroke of the pumping unit 100. The measurements of the pumping unit 100 are specific to the pumping unit 100. Thus, a lengthy process of hand measuring components of the pumping unit 100 may be undertaken for the four-bar-linkage calculation. However, hand measuring the components of the pumping unit 100 is an expensive undertaking that is prone to error.

In operation, the polished rod 110 reaches its extreme positions (e.g., a top position, a bottom position) at different angles of the crank arm 120 depending on the characteristics of the pumping unit 100. To more accurately define the relationship of the crank arm 120 and polished rod 110 in the four-bar-linkage equation, an offset is determined between a particular angular position of the crank arm 120 and a corresponding position of the polished rod 110. The offset is determined based on an angle of the crank arm 120 when the first sensor 128 senses the crank arm 120 and a corresponding position of the polished rod 110. However, because this offset is determined manually and the sample rate of the rod pump controller 129 is approximately 20-times per second, accurately defining the offset is difficult and prone to error.

The four-bar-linkage calculation used to relate the position of the crank arm 120 to the position of the polished rod 110 throughout the stroke of the pumping unit 100 assumes that the couplings (e.g., the belt and sheeve system 116, the gear box 118, etc.) between the motor 114 and the crank arm 120 is rigid and that the pitman 122, the walking beam 108 and the bridle 112 are rigid throughout the stroke of the pumping unit 100. However, this is not the case. Instead, the pitman 122, the walking beam 108 and the bridle 112 vary in length, shape, etc. based on the loads that are imparted thereon. Additionally, flexibility in the belt and sheeve system 116, cyclical loading of the polished rod 110 and the impact on the counterweights 121, 126 cyclically loads the gear box 118, which causes deviations in the relationship between the revolutions of the motor 114, the position of the crank arm 120 and, in turn, the determined position of the polished rod 110. While adjusting the counterweights 121 and/or 126 may minimize the cyclical loading, the deviation in the relationship between the revolutions of the motor 114 and the position of the crank arm 120 cannot be eliminated. Thus, because the four-bar-linkage calculation fails to take into account the non-rigid nature of components of the pumping unit 100, some inaccuracies exist in the corresponding polished rod 110 position determination.

Figure 2:
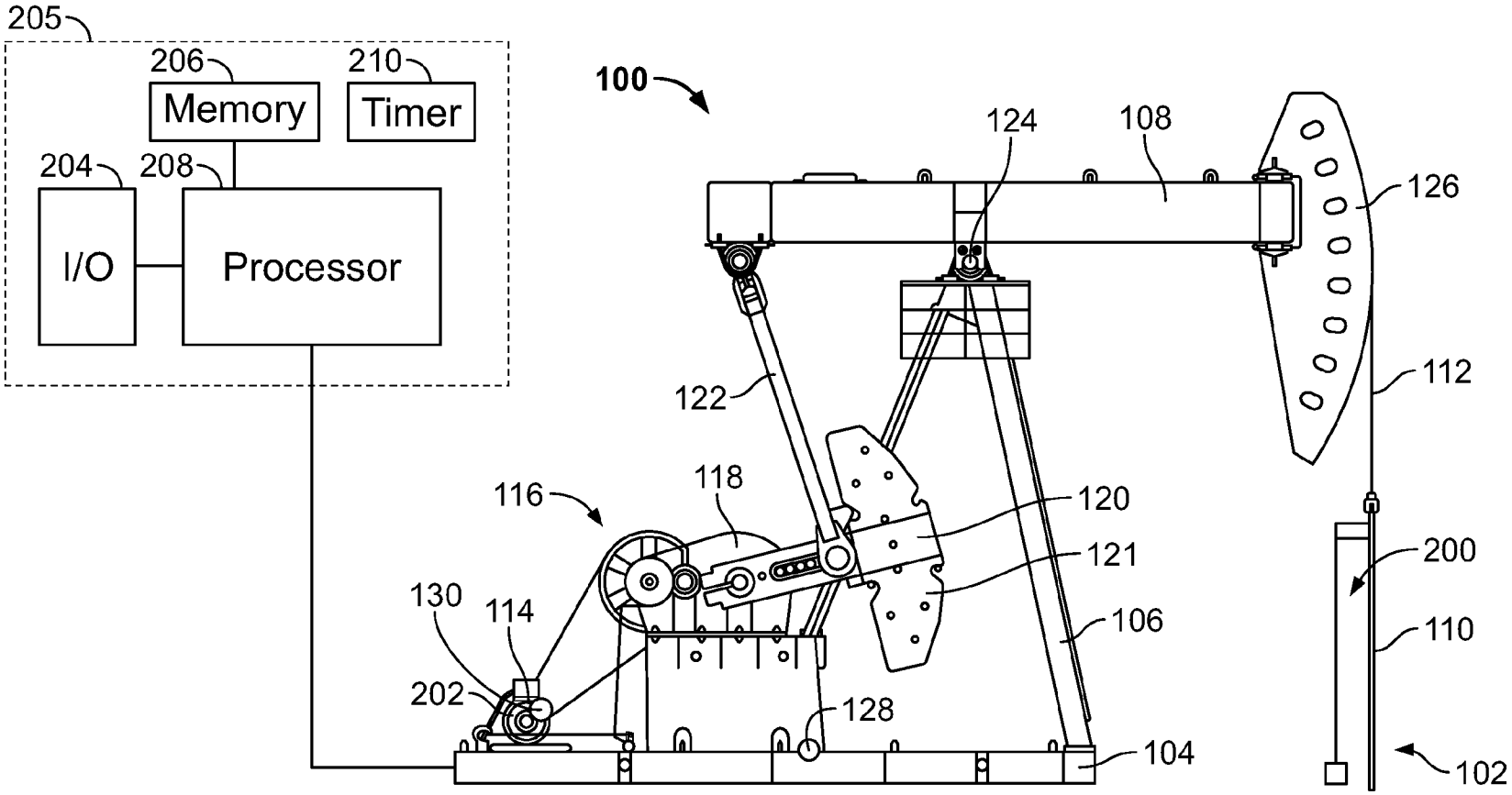
FIG. 2 shows a pumping unit including an example apparatus used to calibrate the pumping unit in accordance with the teachings of this disclosure.

FIG. 2 depicts the pumping unit 100 of FIG. 1 including a third sensor (e.g., a string potentiometer, a linear displacement sensor using radar, laser, etc.) 200 used in combination with the first and second sensors (e.g., proximity sensors) 128, 130 to calibrate the rod pump controller 129 in accordance with the teachings of this disclosure. In contrast to the example of FIG. 1 that relies on measuring the pumping unit 100 and determining a crank arm 120/polished rod 110 offset, the pumping unit 100 of FIG. 2 is calibrated by measuring directly the position of the polished rod 110 and the rotation of the motor 114 throughout a cycle of the crank arm 120.

In some examples, to calibrate the rod pump controller 129 of FIG. 2, the first sensor 128 detects the completion of a cycle of the crank arm 120, the second sensor 130 detects one or more targets 202 coupled to the motor 114 and/or a shaft of the motor 114 as the motor 114 rotates and the third sensor 200 measures directly the position of the polished rod 110 throughout its stroke. Data obtained from the first, second and third sensors 128, 130 and 200 are received by an input/out (I/O) device 204 of an apparatus 205 and stored in a memory 206 that is accessible by a processor 208. For example, during the calibration process, the processor 208 iteratively receives and/or substantially simultaneously receives (e.g., every 5-seconds, between about 5-seconds and 60-seconds) a crank pulse count and/or pulse from the first sensor 128, a motor pulse count versus time and/or a pulse from the second sensor 130 and the position of the polished rod 110 versus time from the third sensor 200. In some examples, a timer 210 is used by the processor 208 and/or the first, second and/or third sensors 128, 130 and/or 200 to determine a sampling period and/or to determine when to request, send and/or receive data (e.g., measured parameter values) from the first, second and third sensors 128, 130 and 200.

In some examples, the processor 208 generates a reference and/or calibration table 300 (FIG. 3) showing the relationship(s) between these measured parameter values (e.g., time, motor pulse count, and polished rod position) for a complete cycle of the pumping unit 100 based on the position of the polished rod 110 versus time and the motor pulse count versus time between two consecutive crank pulse counts. In some examples, time may be measured in seconds and the position of the polished rod 110 may be measured in inches.

Once the calibration process has completed and the corresponding reference table 300 has been generated, the third sensor 200 can be removed from the pumping unit 100 and/or the polished rod 110 and the normal operation and/or continuous operation of the pumping unit 100 can begin. In some examples, during normal operation, based on the crank pulse count obtained from the first sensor 128 and the motor pulse count obtained from the second sensor 130, the processor 208 can use the reference table 300 to determine and/or correlate the particular pulse count within a cycle of the crank arm 120 to the position of the polished rod 110. In some examples, Equation 1 may be used to determine and/or interpolate the position of the polished rod 110 if, for example, a particular pulse count of the motor 114 is not listed in the reference table. Referring to Equation 1, i corresponds to the index of the identified point in the calibration table where the table pulse count is greater than or equal to the motor pulse count, Position relates to the position of the polished rod 110, pos relates to the position entry in the reference table, ΔPulses relates to the number of pulses of the motor 114 measured by the second sensor 130 since a crank pulse indication was received from the first sensor 128 and pulses relates to the pulse count entry of the motor 114 in the calibration table.

$$\text{Position} = pos_{(i-1)} + [pos_{(i)} - pos_{(i-1)}]\frac{[\Delta Pulses - \text{pulses}_{(i-1)}]}{[\text{pulses}_{(i)} - \text{pulses}_{(i-1)}]} \quad \text{Equation 1}$$

As the position of the polished rod 110 is determined, the determined position data (e.g., position versus time data) is saved in the memory 206 and/or used by the processor 208 to generate a dynamometer card such as, for example, a rod pump dynamometer card, a surface dynamometer card, a pump dynamometer card, etc.

FIG. 3 shows the example reference table 300 that can be generated in connection with and/or used to implement the examples disclosed herein. The example reference table 300 includes first columns 302 corresponding to time received from and/or determined by the timer 210, second columns 304 corresponding to the pulse count of the motor 114 received from and/or determined by the second sensor 130 and third columns 306 corresponding to the position of the polished rod 110 received from and/or determined by the third sensor 200. In some examples, the data included in the reference table 300 relates to a single revolution of the crank arm 120.

Figure 4:
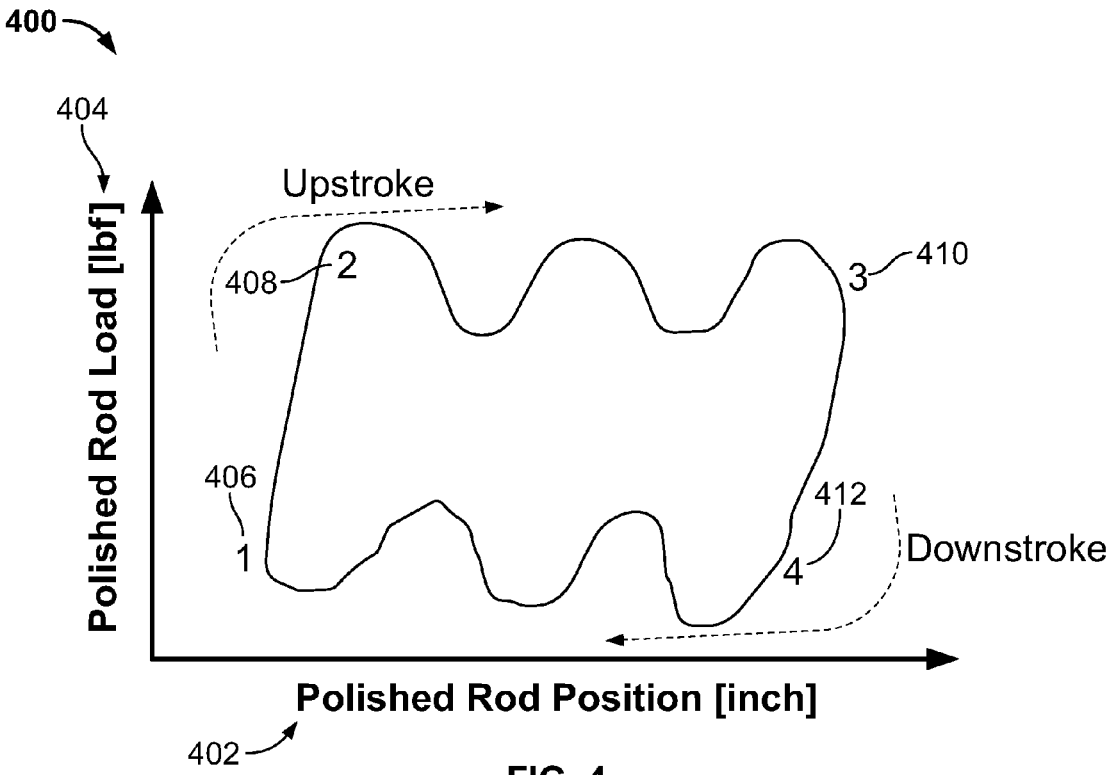
FIG. 4 shows an example surface dynamometer card that can be produced in accordance with the teachings of this disclosure.

FIG. 4 shows an example surface dynamometer card 400 that can be generated in accordance with the teachings of this disclosure using data associated with the vertical displacement of the polished rod 110 versus time and data associated with tension on the polished rod 110 versus time.

In some examples, the surface dynamometer card 400 represents when the downhole pump is operating normally with adequate liquid to pump. As shown in FIG. 4, the x-axis 402 corresponds to the position of the polished rod 110 and the y-axis 404 corresponds to the load on the polished rod 110.

Reference number 406 relates to when the polished rod 110 begins its upward motion to begin to lift a column of fluid. Between reference numbers 406 and 408, the increase in tension on the polished rod 110 as the rods are stretched and the fluid column is lifted is shown. Reference number 408 relates to when the pumping unit 100 is supporting the weight of a sucker rod string and the weight of the accelerating fluid column. Between reference numbers 408 and 410, force waves arrive at the surface as the upstroke continues, which causes the load on the polished rod 210 to fluctuate. Reference number 410 relates to when the polished rod 110 has reached its maximum upward displacement. Between reference numbers 410 and 412, the fluid load is transferred from the sucker rod string to a tubing string, which causes the tension in the polished rod 110 to decrease. Reference number 412 relates to when the load has substantially and/or completely transferred to the tubing string. Between reference numbers 412 and 406, force waves reflect to the surface as the downstroke continues, which causes irregular loading on the polished rod 110 until the polished rod 110 reaches its lowest point and begins another stroke.

Figure 5:
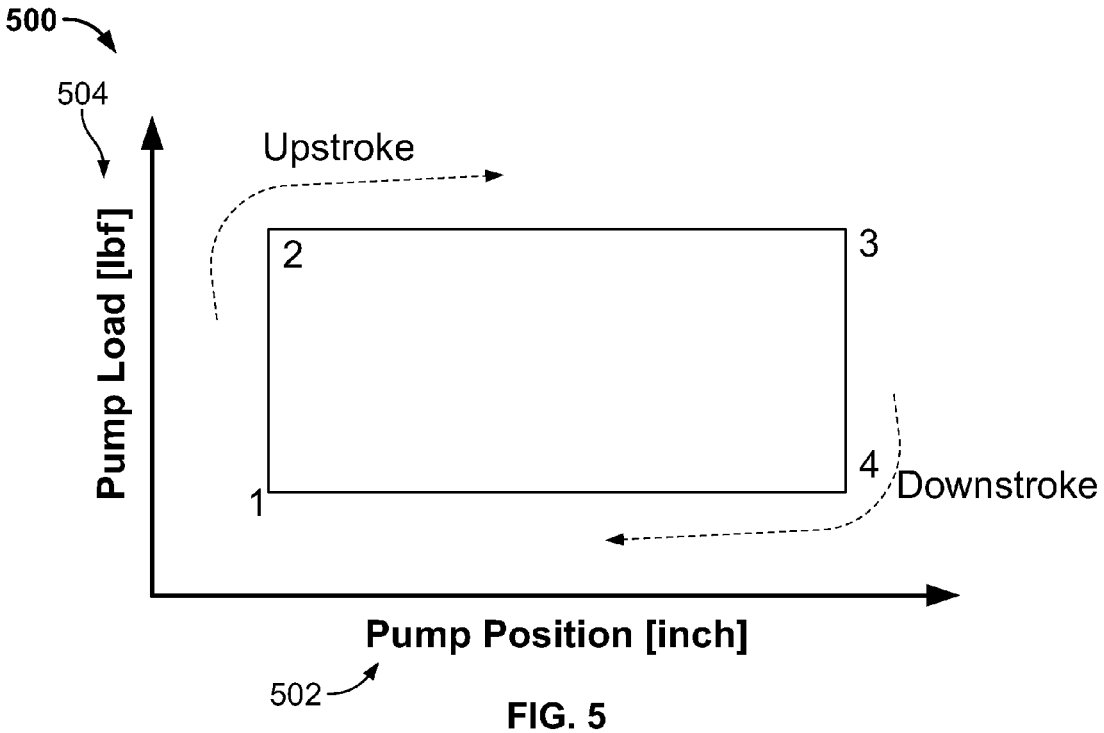
FIG. 5 shows an example pump dynamometer card that can be produced in accordance with the teachings of this disclosure.

FIG. 5 shows an example pump dynamometer card 500 that can be generated in accordance with the teachings of this disclosure using data associated with the position of the polished rod 110 and the load on the polished rod 110. In some examples, the pump dynamometer card 500 is generated using data measured at the surface. As shown in FIG. 5, the x-axis 502 corresponds to the position of the downhole pump and the y-axis 504 corresponds to the load on the downhole pump.

While an example manner of implementing the apparatus 205 is illustrated in FIG. 2, one or more of the elements, processes and/or devices illustrated in FIG. 2 may be combined, divided, re-arranged, omitted, eliminated and/or implemented in any other way. Further, the I/O device 204, the memory 206, the processor 208 and/or, more generally, the example apparatus 205 of FIG. 2 may be implemented by hardware, software, firmware and/or any combination of hardware, software and/or firmware. Thus, for example, any of the I/O device 204, the memory 206, the processor 208, the timer 210 and/or, more generally, the example apparatus 205 of FIG. 2 could be implemented by one or more analog or digital circuit(s), logic circuits, programmable processor (s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example I/O device 204, the memory 206, the processor 208, the timer 210 and/or, more generally, the example apparatus 205 of FIG. 2 is/are hereby expressly defined to include a tangible computer readable storage device or storage disk such as a memory, a digital versatile disk (DVD), a compact disk (CD), a Blu-ray disk, etc. storing the software and/or firmware. Further still, the example apparatus 205 of FIG. 2 may include one or more elements, processes and/or devices in addition to, or instead of, those illustrated in FIG. 2, and/or may include more than one of any or all of the illustrated elements, processes and devices. While FIG. 2 depicts a conventional crank-balanced pumping unit, the examples disclosed herein can be implemented in connection with any other pumping unit.

Figure 6:
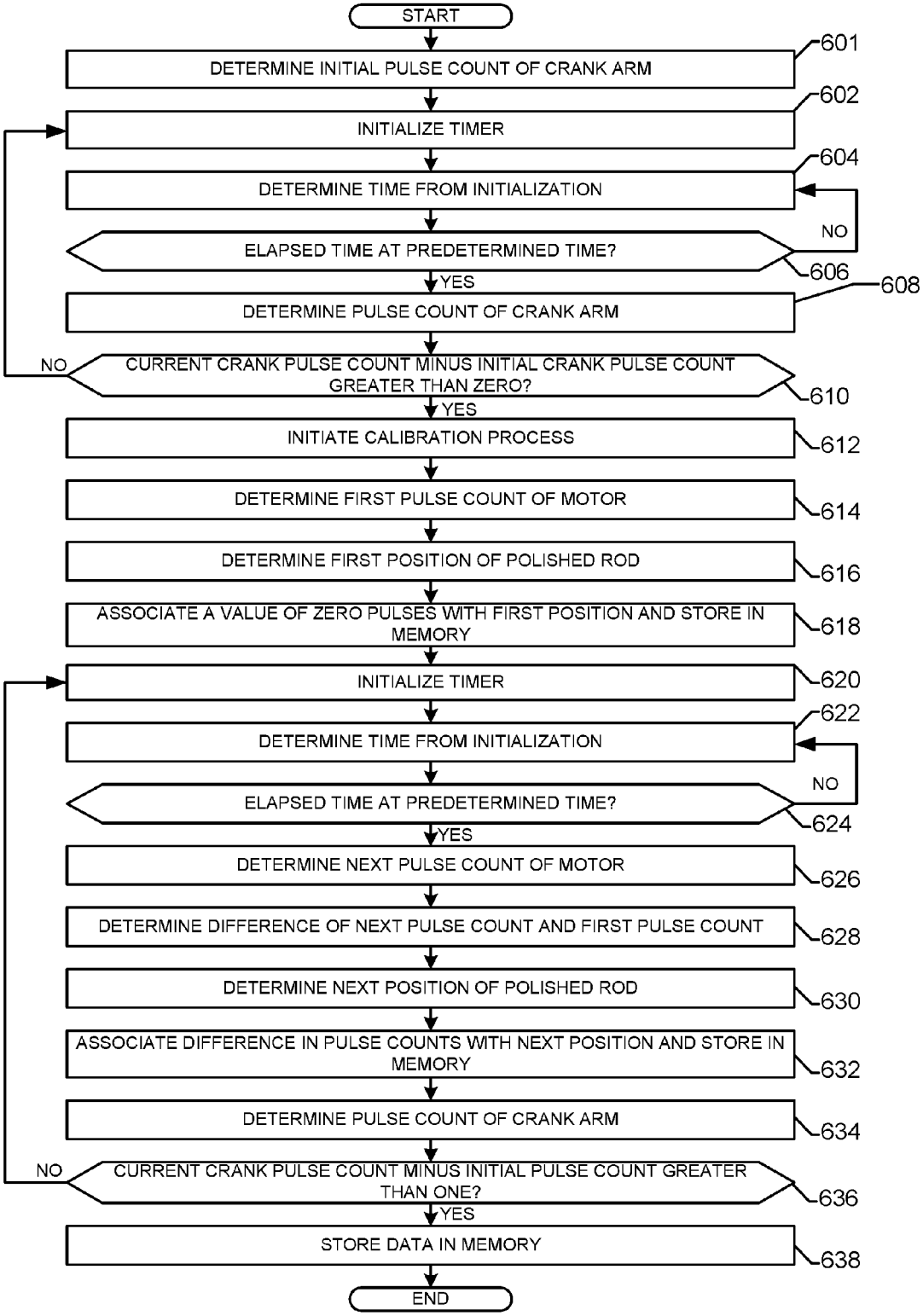
FIGS. 6 and 7 are flowcharts representative of example methods that may be used to implement the example apparatus of FIG. 2.
Figure 7:
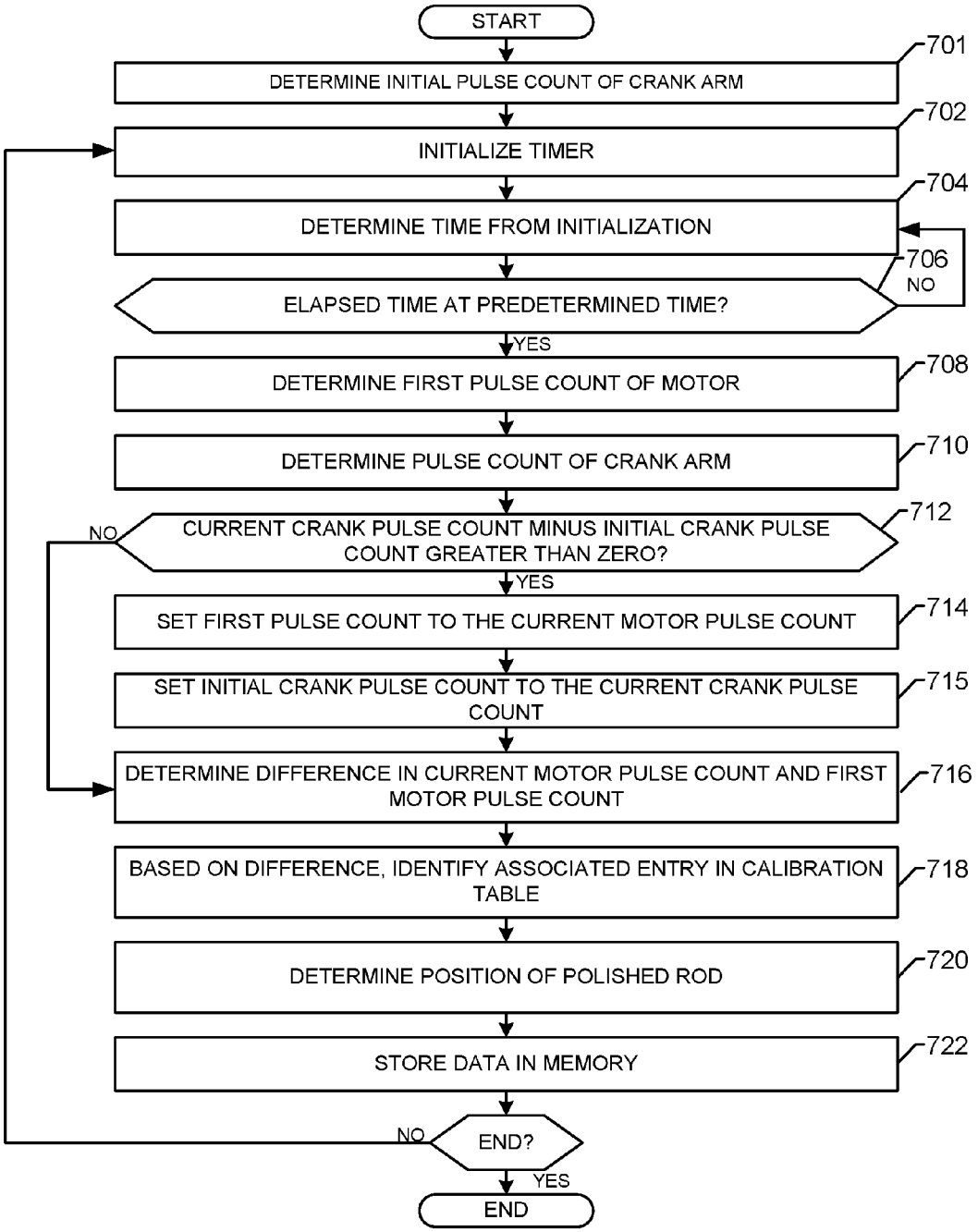

Flowcharts representative of example methods for implementing the apparatus 205 of FIG. 2 are shown in FIGS. 6 and 7. In this example, the methods of FIGS. 6 and 7 may be implemented by machine readable instructions that comprise a program for execution by a processor such as the processor 812 shown in the example processor platform 800 discussed below in connection with FIG. 8. The program may be embodied in software stored on a tangible computer readable storage medium such as a CD-ROM, a floppy disk, a hard drive, a digital versatile disk (DVD), a Blu-ray disk, or a memory associated with the processor 812, but the entire program and/or parts thereof could alternatively be executed by a device other than the processor 812 and/or embodied in firmware or dedicated hardware. Further, although the example program is described with reference to the flowcharts illustrated in FIGS. 6 and 7 many other methods of implementing the example apparatus 205 may alternatively be used. For example, the order of execution of the blocks may be changed, and/or some of the blocks described may be changed, eliminated, or combined.

As mentioned above, the example methods of FIGS. 6 and 7 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example methods of FIGS. 6 and 7 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The method of FIG. 6 begins in a calibration preparation mode that includes determining an initial pulse count of the crank arm 120 (block 601). At block 602, the processor 208 initiates and/or initializes the timer 210 (block 602). At block 604, the processor 208 determines, via the timer 210, the amount of time elapsed since the timer 210 was initialized (block 604). At block 606, the processor 208 determines if the elapsed time is at or after a predetermined time such as, for example, fifty milliseconds (block 606). The timer 210 may be used to set a sampling period and/or to substantially ensure data is obtained from the first, second and/or third sensors 128, 130, 200 at equal frequencies. If the processor 208 determines that the elapsed time is at or after the predetermined time, based on data from the first sensor 128, the processor 208 determines the pulse count of the crank arm 120 (block 608). At block 610, the processor 208 determines, based on data from the first sensor 128, if the difference between the current pulse count of the crank arm 120 and the initial pulse count of the crank arm 120 is greater than zero (block 610). In some examples, the pulse count of the crank arm 120 changes from zero to one once a cycle of the crank arm 120 has completed. In examples in which the pulse count begins at one, the processor 208 determines if the pulse count of the crank arm 120 has changed.

If the pulse count of the crank arm 120 is equal to zero, based on data from the first sensor 128, the processor 208 again initializes the timer 210 (block 602). However, if the pulse count difference is greater than zero, the calibration process is initiated (block 612). At block 614, the second sensor 130 determines a first pulse count of the motor 114 (block 614). In other examples, immediately after the calibration process is initiated, the pulse count of the motor is not obtained. At block 616, based on data from the third sensor 200, the processor 208 determines a first position of the polished rod 110 (block 616). The processor 208 then associates a value of zero pulses with the first position of the polished rod 110 and stores this data in the memory 206 (block 618). For example, the pulse count may be stored in a first entry 308 of the second column 304 of the reference table 300 and the first position of the polished rod 110 may be stored in a first entry 310 of the third column 306 of the reference table 300.

At block 620, the processor 208 again initiates and/or initializes the timer 210 (block 620). At block 622, the processor 208 determines, via the timer 210, the amount of time elapsed since the timer 210 was initialized (block 622). At block 624, the processor 208 determines if the elapsed time is at or after a predetermined time such as, for example, fifty milliseconds (block 624). If the processor 208 determines that the elapsed time is at or after the predetermined time, based on data from the second sensor 130, the processor 208 determines a second and/or next pulse count of the motor 114 (block 626).

At block 628, the processor 208 determines the difference between the second and/or next pulse count and the first pulse count (block 628). At block 630, based on data from the third sensor 200, the processor 208 determines a second and/or next position of the polished rod 110 (block 630). At block 632, the processor 208 associates the difference between the first and second pulse counts with the second position and/or next position of the polished rod 110 and stores the data in the memory 206. For example, the pulse count difference may be stored in a second entry 312 of the second column 304 of the reference table 300 and the second position of the polished rod 110 may be stored in a second entry 314 of the third column 306 of the reference table 300.

At block 634, based on data from the first sensor 128, the processor 208 determines the pulse count of the crank arm 120 (block 634). At block 636, the processor 208 determines if the difference between the current pulse count of the crank arm 120 and the initial pulse count of the crank arm 120 is greater than one (block 636). In some examples, the pulse count of the crank arm 120 changes if the crank arm 120 has completed a cycle. At block 638, the collected data, the generated reference table 300 and/or the processed data are stored in the memory 206 (block 638). The generated reference table 300 can be used in combination with data from the first and/or second sensors 128, 130 to determine the position of the polished rod 120 when the pumping unit 100 operates continuously.

The operations of FIG. 7, such as determining the position and/or the load imparted on the polished rod 210, can be performed while continuously operating the pumping unit 100. The method of FIG. 7 begins with the processor 208 determining an initial pulse count of the crank arm 120 (block 701). The processor 208 initiates and/or initializes the timer 210 (block 702). At block 704, the processor 208 determines, via the timer 210, the amount of time that has elapsed since the timer 210 was initialized (block 704). At block 706, the processor 208 determines if the elapsed time is at or after a predetermined time such as, for example, five seconds (block 706). The timer 210 may be used to substantially ensure data is obtained from the first and/or second sensors 128, 130 at equal frequencies. If the processor 208 determines that the time is at or after the predetermined time, based on data from the second sensor 130, the processor 208 determines a first pulse count of the motor 114 (block 708).

Based on data from the first sensor 128, the processor 208 determines the pulse count of the crank arm 120 (block 710). At block 712, based on data from the first sensor 128, the processor 208 determines if the difference between current pulse count of the crank arm 120 and the initial pulse count of the crank arm 120 is greater than zero (block 712). In some examples, the pulse count of the crank arm 120 changes once a cycle of the crank arm 120 has completed.

If the difference is greater than zero, the processor 208 sets the current pulse count to the first pulse count (block 714). The processor 208 may also set the initial pulse count of the crank arm 120 to the current pulse count of the crank arm 120 (block 715). At block 716, the processor 208 determines the difference between the current motor pulse count and the first pulse count (block 716). At block 718, the processor 208 references the reference table 300 to identify an entry in the reference table 300 that corresponds to the difference in the motor counts (block 718). For example, if the difference in the pulse counts is zero, the corresponding entry in the reference table 300 corresponds to entry 308.

At block 720, the processor 208 uses the reference table 300 and/or Equation 1 to determine a corresponding position of the polished rod 110 (block 720). For example, if the difference in the pulse counts is zero, the corresponding entry for the position of the polished rod 110 in the reference table 300 corresponds to entry 310. In some examples, Equation 1 may be used to determine and/or interpolate the position of the polished rod 110 if, for example, a particular pulse count of the motor 114 is not listed in the reference table 300. At block 722, the data that has been obtained and/or determined is stored in the memory 206 (block 722). The stored data can be used by the processor 208 to determine the velocity of the polished rod 110, the acceleration of the polished rod 110 and/or to generate a rod pump dynamometer card, a surface dynamometer card, a pump dynamometer card, etc.

Figure 8:
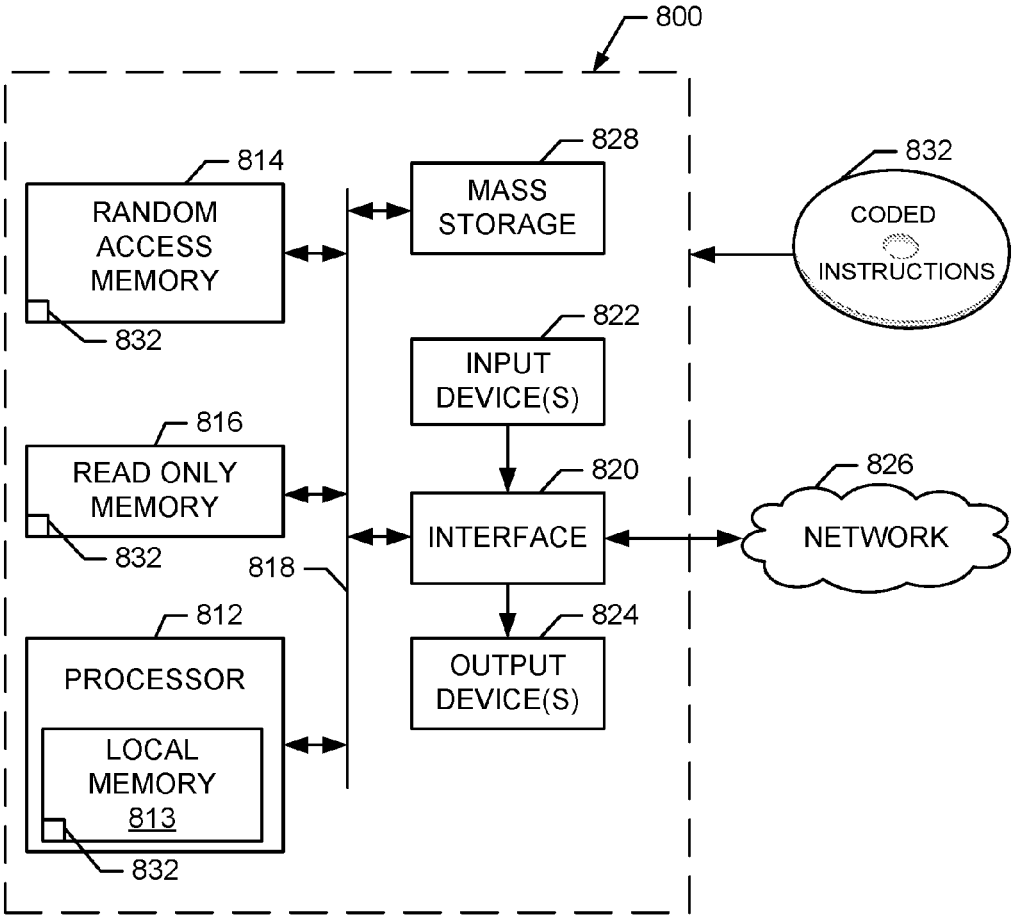
FIG. 8 is a processor platform to implement the methods of FIGS. 6 and 7 and/or the apparatus of FIG. 2.

FIG. 8 is a block diagram of an example processor platform 800 capable of executing the instructions to implement the methods of FIGS. 6 and 7 and/or the apparatus of FIG. 2. The processor platform 800 can be, for example, a server, a personal computer, a mobile device (e.g., a cell phone, a smart phone, a tablet such as an iPad™), a personal digital assistant (PDA), an Internet appliance, or any other type of computing device.

The processor platform 800 of the illustrated example includes a processor 812. The processor 812 of the illustrated example is hardware. For example, the processor 812 can be implemented by one or more integrated circuits, logic circuits, microprocessors or controllers from any desired family or manufacturer.

The processor 812 of the illustrated example includes a local memory 813 (e.g., a cache). The processor 812 of the illustrated example is in communication with a main memory including a volatile memory 814 and a non-volatile memory 816 via a bus 818. The volatile memory 814 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 816 may be implemented by flash memory and/or any other desired type of memory device. Access to the main memory 814, 816 is controlled by a memory controller.

The processor platform 800 of the illustrated example also includes an interface circuit 820. The interface circuit 820 may be implemented by any type of interface standard, such as an Ethernet interface, a universal serial bus (USB), and/or a PCI express interface.

In the illustrated example, one or more input devices 822 are connected to the interface circuit 820. The input device (s) 822 permit(s) a user to enter data and commands into the processor 1012. The input device(s) can be implemented by, for example, an audio sensor, a microphone, a keyboard, a button, a mouse, a touchscreen, a track-pad and/or a trackball.

One or more output devices 824 are also connected to the interface circuit 820 of the illustrated example. The output devices 824 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED). The interface circuit 820 of the illustrated example, thus, typically includes a graphics driver card, a graphics driver chip or a graphics driver processor.

The interface circuit 820 of the illustrated example also includes a communication device such as a transmitter, a receiver, a transceiver, a modem and/or network interface card to facilitate exchange of data with external machines (e.g., computing devices of any kind) via a network 826 (e.g., an Ethernet connection, a digital subscriber line (DSL), a telephone line, coaxial cable, a cellular telephone system, etc.).

The processor platform 800 of the illustrated example also includes one or more mass storage devices 828 for storing software and/or data. Examples of such mass storage devices 828 include floppy disk drives, hard drive disks, compact disk drives, Blu-ray disk drives, RAID systems, and digital versatile disk (DVD) drives.

Coded instructions 832 to implement the methods of FIGS. 6 and 7 may be stored in the mass storage device 828, in the volatile memory 814, in the non-volatile memory 816, and/or on a removable tangible computer readable storage medium such as a CD or DVD.

From the foregoing, it will be appreciated that the above disclosed methods, apparatus and articles of manufacture result in a more accurate determination of the position of the polished rod during continuous operation. Additionally or alternatively, the first, second and/or third sensors automatically accurately determine the pump stroke offset value between the position of the crank arm and the polished rod during the calibration processes, thereby resulting in a more accurate determination of the position of the polished rod during continuous operation. Additionally or alternatively, to calibrate a rod pump controller using the examples disclosed herein, no hand-measuring of the pumping unit is needed. Thus, calibrating a rod pump controller using the examples disclosed herein requires less time and is less expensive than some known methods.

As set forth herein, an example method includes moving a polished rod of a pumping unit through a first cycle of the pumping unit using a motor and determining first pulse count values of the motor through the first cycle using a first sensor at first times, the first times being substantially equally spaced. The method also includes determining first position values of the polished rod through the first cycle using a second sensor at the first times and associating the first pulse count values with respective ones of the first position values to calibrate a processor of the pumping unit.

In some examples, the method also includes generating a reference table using the first pulse count values and the first position values obtained at the first times to show a correlation between the first pulse count values and the first position values. In some examples, the method also includes removing the second sensor and continuously operating the pumping unit. In some examples, the method also includes determining second position values of the polished rod versus time while the pumping unit is continuously operating using the reference table in combination with data from the first sensor. In some examples, the data includes determining second pulse count values of the motor through a second cycle using the first sensor at second times.

In some examples, the method also includes determining a velocity of the polished rod versus time based on the determined second position values of the polished rod versus time. In some examples, the method also includes determining an acceleration of the polished rod versus time based on the determined second position values of the polished rod versus time. In some examples, the method also includes generating a dynamometer card based on the determined second position values of the polished rod versus time. In some examples, the dynamometer card includes a surface dynamometer card. In some examples, the dynamometer card includes a pump dynamometer card.

In some examples, determining the first pulse count values comprises detecting a target on the motor using the first sensor. In some examples, a third sensor monitors a completion of the first cycle.

An example method includes calibrating a processor of a pumping unit to generate calibration data by determining a correlation between pulse count values of a motor using a first sensor and a position of a polished rod using a second sensor. The method includes removing the second sensor from the pumping unit, moving the polished rod of the pumping unit using the motor and monitoring a position of a crank arm to determine when a cycle of the crank arm has completed. The method includes monitoring a second pulse of the motor through the cycle using a first sensor and determining a position of the polished rod versus time based on the monitoring of the second pulse count, and a comparison to the calibration data.

In some examples, the method also includes determining a velocity of the polished rod versus time based on the determined position of the polished rod versus time. In some examples, the method also includes determining an acceleration of the polished rod versus time based on the determined position of the polished rod versus time. In some examples, the method also includes generating a dynamometer card based on the determined position of the polished rod versus time. In some examples, the dynamometer card comprises a surface dynamometer card. In some examples, the dynamometer card includes a pump dynamometer card. In some examples, determining the pulse count values comprises detecting a target on the motor using the first sensor.

An example apparatus includes a housing and a processor positioned in the housing. The processor is to receive first pulse count values of a motor of a pumping unit at first times through a first cycle of the pumping unit. The first times are substantially incrementally spaced. The processor is to receive first position values of a polished rod of the pumping unit through the first cycle, the processor to correlate the first pulse counts and the first positions to calibrate the pumping unit. In some examples, the apparatus comprises a rod-pump controller.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method, comprising:

moving a polished rod of a pumping unit through a first cycle of the pumping unit using a motor;

determining first pulse count values of the motor through the first cycle using a first sensor at first times, the first times being substantially equally spaced;

determining first position values of the polished rod through the first cycle using a second sensor at the first times;

associating the first pulse count values with respective ones of the first position values to calibrate a processor of the pumping unit;

generating a reference table using the first pulse count values and the first position values obtained at the first times to show a correlation between the first pulse count values and the first position values;

removing the second sensor and continuously operating the pumping unit; and determining second position values of the polished rod versus time while the pumping unit is continuously operating using the reference table in combination with data from the first sensor.

2. The method of claim 1, wherein the data includes determining second pulse count values of the motor through a second cycle using the first sensor at second times.

3. The method of claim 1, further comprising determining a velocity of the polished rod versus time based on the determined second position values of the polished rod versus time.

4. The method of claim 1, further comprising determining an acceleration of the polished rod versus time based on the determined second position values of the polished rod versus time.

5. The method of claim 1, further comprising generating a dynamometer card based on the determined second position values of the polished rod versus time.

6. The method of claim 5, wherein the dynamometer card comprises a surface dynamometer card.

7. The method of claim 5, wherein the dynamometer card comprises a pump dynamometer card.

8. The method of claim 1, wherein determining the first pulse count values comprises detecting a target on the motor using the first sensor.

9. The method of claim 1, wherein a third sensor monitors a completion of the first cycle.

10. A method, comprising:

calibrating a processor of a pumping unit to generate calibration data by correlating pulse count values of a motor using a first sensor and a first position of a polished rod using a second sensor;

removing the second sensor from the pumping unit and continuously operating the pumping unit; and determining a second position of the polished rod versus time while the pumping unit is continuously operating using the correlation between the pulse count values of the motor and the first position of the polished rod in combination with data from the first sensor.

11. The method of claim 10, further comprising determining an acceleration of the polished rod versus time based on the determined position of the polished rod versus time.

12. The method of claim 10, further comprising determining a velocity of the polished rod versus time based on the determined position of the polished rod versus time.

13. The method of claim 12, further comprising generating a dynamometer card based on the determined position of the polished rod versus time.

14. The method of claim 13, wherein the dynamometer card comprises a surface dynamometer card.

15. The method of claim 13, wherein the dynamometer card comprises a pump dynamometer card.

16. The method of claim 10, wherein determining the pulse count values comprises detecting a target on the motor using the first sensor.

17. An apparatus, comprising:

a housing; and a processor positioned in the housing, the processor to receive first pulse count values of a motor of a pumping unit at first times through a first cycle of the pumping unit, the first times being substantially incrementally spaced, the processor to receive first position values of a polished rod of the pumping unit through the first cycle, the processor to:

generate a reference table using the first pulse count values and the first position values obtained at the first times to show a correlation between the first pulse count values and the first position values;

cause the pumping unit to be continuously operated after the second sensor has been removed; and determine second position values of the polished rod versus time while the pumping unit is continuously operating using the reference table in combination with data from the first sensor.

18. The apparatus of claim 17, wherein the apparatus comprises a rod-pump controller.

* * * * *